US009057151B2

(12) United States Patent
Kim et al.

(10) Patent No.: US 9,057,151 B2
(45) Date of Patent: Jun. 16, 2015

(54) DOOR ASSEMBLY OF A DRUM TYPE WASHING MACHINE

(75) Inventors: Jin Woong Kim, Seoul (KR); Young Min Kim, Seoul (KR); Dong Won Kim, Seoul (KR); Bo Sung Seo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 1107 days.

(21) Appl. No.: 12/879,599

(22) Filed: Sep. 10, 2010

(65) Prior Publication Data

US 2011/0062838 A1 Mar. 17, 2011

(30) Foreign Application Priority Data

Sep. 14, 2009 (KR) ..... 10-2009-0086531
Sep. 14, 2009 (KR) ..... 10-2009-0086532

(51) Int. Cl.
*D06F 39/14* (2006.01)
*D06F 23/02* (2006.01)

(52) U.S. Cl.
CPC ..... *D06F 39/14* (2013.01); *D06F 23/025* (2013.01); *D06F 2224/00* (2013.01)

(58) Field of Classification Search
CPC ..... E05F 3/20; E05F 5/08; E05F 5/02; E05F 1/1215; D06F 39/14; D06F 23/025; D06F 2224/00; A47B 2210/0094
USPC ..... 312/215, 222, 228; 68/12.26, 196; 292/95, DIG. 69, 121, 116, 117, 128; 215/269, 270, 271, 300; 16/49, 61, 69, 16/70, 71, 63, 78, 65; 49/33, 54, 62, 63, 49/65, 67, 89.1, 125, 168
See application file for complete search history.

(56) References Cited

U.S. PATENT DOCUMENTS

| | | | | |
|---|---|---|---|---|
| 7,154,058 | B2 * | 12/2006 | Kim et al. | 200/302.1 |
| 7,269,981 | B2 * | 9/2007 | Kwon | 68/3 R |
| 7,377,500 | B2 * | 5/2008 | Tomiji et al. | 267/64.15 |
| 2004/0016613 | A1 * | 1/2004 | Uemura | 188/313 |
| 2006/0101873 | A1 * | 5/2006 | Kim et al. | 68/196 |
| 2007/0163077 | A1 * | 7/2007 | Yang et al. | 16/85 |
| 2008/0295283 | A1 * | 12/2008 | Tice | 16/84 |
| 2009/0251032 | A1 * | 10/2009 | Jeon et al. | 312/220 |

FOREIGN PATENT DOCUMENTS

| | | | | |
|---|---|---|---|---|
| GB | 2075109 | A | * 11/1981 | E05C 19/18 |
| KR | 10-2007-0038720 | A | 4/2007 | |
| KR | 10-2009-0079793 | A | 7/2009 | |
| KR | 10-2009-0079794 | A | 7/2009 | |

* cited by examiner

*Primary Examiner* — Michael Barr
*Assistant Examiner* — Irina Graf
(74) *Attorney, Agent, or Firm* — McKenna Long & Aldridge LLP

(57) ABSTRACT

A drum type washing machine including a body having a front surface thereof with an entrance opening for entrance/exit of laundry, and a front door rotatably coupled at one end thereof to the front surface of the body and serving to open or close the entrance opening. The drum type washing machine further including a door elastic member providing the front door with an elastic force required to open the entrance opening when the entrance opening is closed by the front door. A supporting unit is installed to the front door and is adapted to come into contact with the body upon opening or closing of the entrance opening, thereby serving to keep the front door at a predetermined distance from the body.

6 Claims, 9 Drawing Sheets

DOOR ASSEMBLY OF A DRUM TYPE WASHING MACHINE

The present application claims priority to Korean Application No. 10-2009-0086531 filed in Korea on Sep. 14, 2009 and Korean Application No. 10-2009-0086532 filed in Korea on Sep. 14, 2009, the entire contents of which are hereby incorporated by reference in their entirety.

BACKGROUND OF THE INVENTION

1. Field of the Disclosure

The present disclosure relates to a drum type washing machine, and more particularly, to a drum type washing machine in which a front door is capable of being kept slightly opened when the drum type washing machine is not in use.

2. Discussion of the Related Art

Generally, laundry treating appliances commonly refer to a variety of apparatuses for treating laundry by applying physical and chemical actions to the laundry, such as, e.g., a washing apparatus, a drying apparatus, and a refresher. The washing apparatus serves to separate contaminants adhered to clothes, bedclothes, etc. (hereinafter, simply referred to as "laundry") using, e.g., chemical dissolution of water and detergent and physical friction of water and laundry. The drying apparatus serves to dehydrate and dry wet laundry. The refresher functions not only to prevent allergic reaction to laundry by ejecting heated steam to the laundry, but also to achieve simple washing of the laundry.

The washing apparatus, as one kind of laundry treating appliance, is classified, according to a configuration and a washing method thereof, into an agitator type, a drum type, and a pulsator type. Although this washing apparatus is conventionally designed to sequentially perform a wash cycle, a rinse cycle, and a spin cycle for washing laundry, usually a desired one or more of the above mentioned cycles may be performed according to a user selection. Also, washing of laundry is accomplished using an appropriate washing method selected according to the kind of laundry.

In particular, of the above described various laundry treating appliances, there is a drum type washing machine. The drum type washing machine includes a body defining an interior space to receive laundry therein. The body is formed, in a front surface thereof, with an entrance opening, to allow a user to put or take laundry into or out of the interior space through a front side of the body. The drum type washing machine further includes a front door pivotally rotatably installed to the front surface of the body, so as to open or close the entrance opening.

However, in the case of the above described conventional drum type washing machine, the entrance opening is always kept closed by the front door even when the drum type washing machine is not in use, causing highly humid air in the interior space. This highly humid air and hermetically sealed environment of the interior space may cause propagation of bacteria, mold, and etc., and consequently, may contradict an intrinsic purpose of the laundry treating appliance to maintain cleanliness and sanitation of clothes.

Another disadvantage as will be appreciated from the above description is that it may be necessary for the user to keep the front door opened at any time for the purpose of preventing bacteria from propagating in the interior space of the body.

In addition, if the front door is kept opened, the front door may interfere with surrounding objects, or may deteriorate the exterior aesthetics of the surrounding.

SUMMARY OF THE INVENTION

One object is to provide a drum type washing machine, which includes a supporting unit to keep a front door at a predetermined distance from the entrance opening.

However, other objects will become evident to those skilled in the art from the following description.

To achieve one or more objects, there is provided a drum type washing machine comprising a body having a front surface thereof with an entrance opening for entrance/exit of laundry, and a front door rotatably coupled at one end thereof to the front surface of the body and serving to open or close the entrance opening. A supporting unit is installed to the front door and is adapted to come into contact with the body upon opening or closing of the entrance opening, thereby serving to keep the front door at a predetermined distance from the body.

DETAILED DESCRIPTION OF THE PREFERRED EMBODIMENTS

Figure 1:
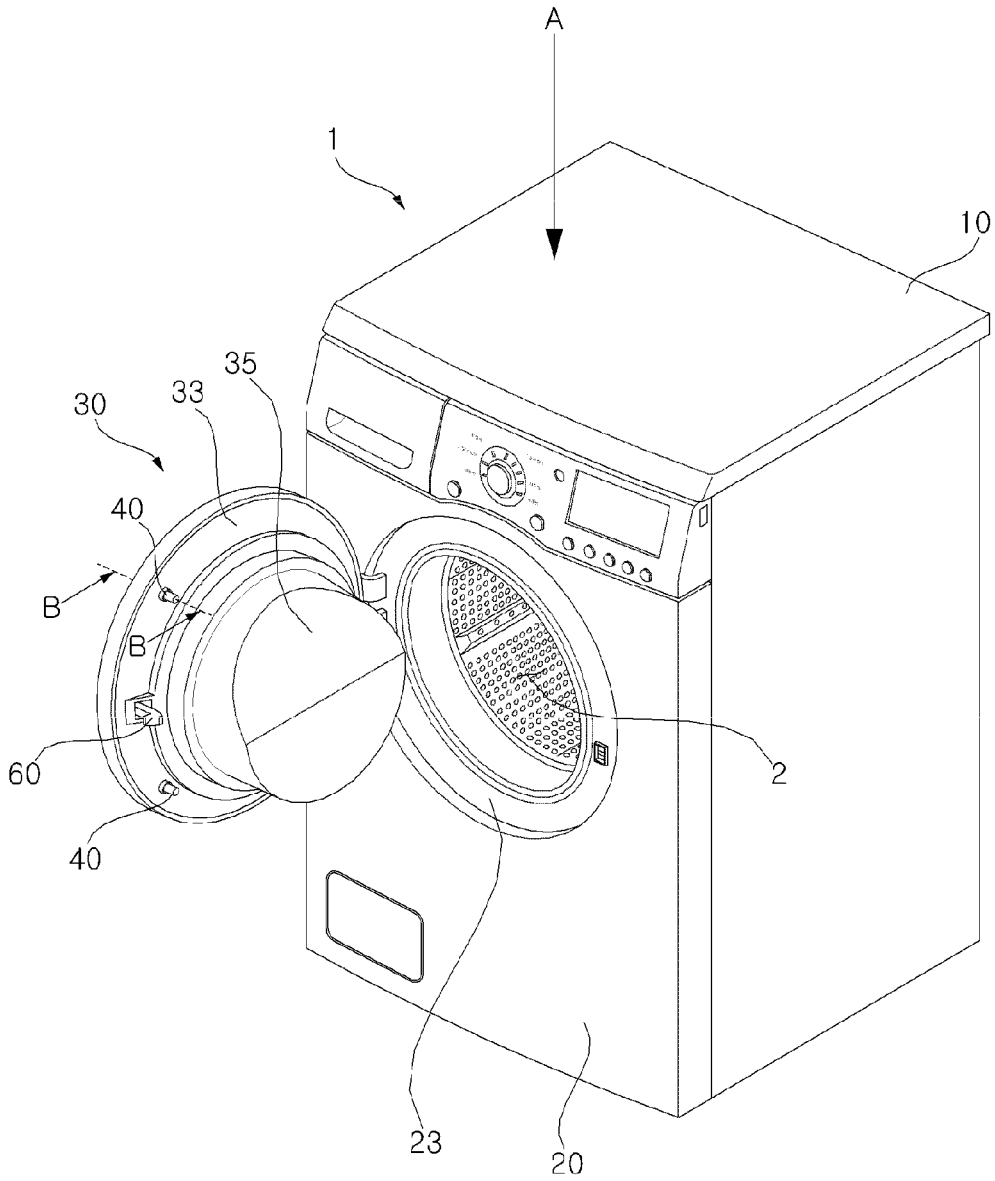
FIG. 1 is a perspective view illustrating a drum type washing machine according to an embodiment of the present invention.

Advantages, features, and ways of attaining them, will become apparent with reference to embodiments described below in conjunction with the accompanying drawings. However, the present invention is not limited to the embodiments disclosed below and can be embodied in a variety of different forms; rather, these embodiments are provided so that this disclosure will be thorough and complete. Like reference numerals refer to like elements throughout the specification.

Now, exemplary embodiments of a drum type washing machine according to an embodiment of the present invention will be described in detail with reference to the accompanying drawings.

Figure 2:
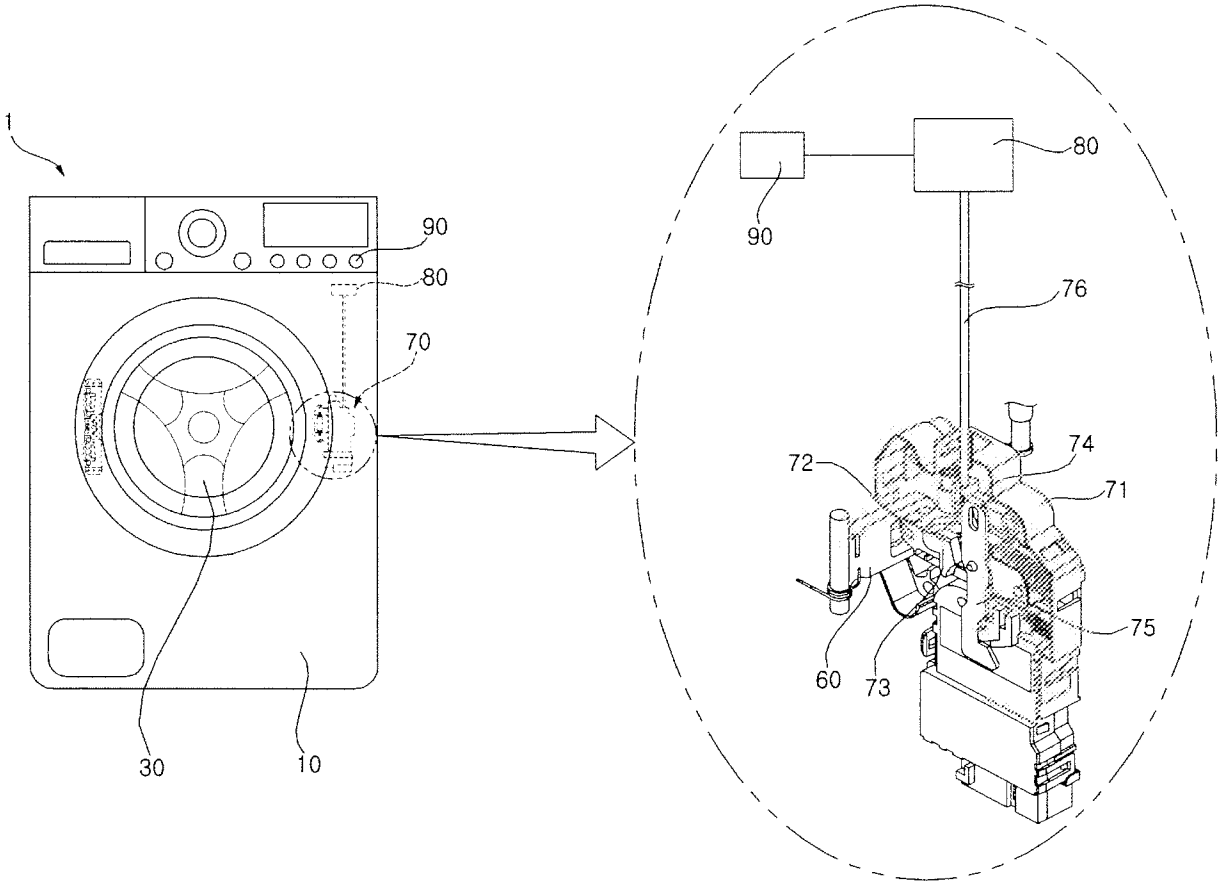
FIG. 2 is a schematic diagram illustrating a door latch assembly to lock or unlock a front door shown in FIG. 1.
Figure 3:
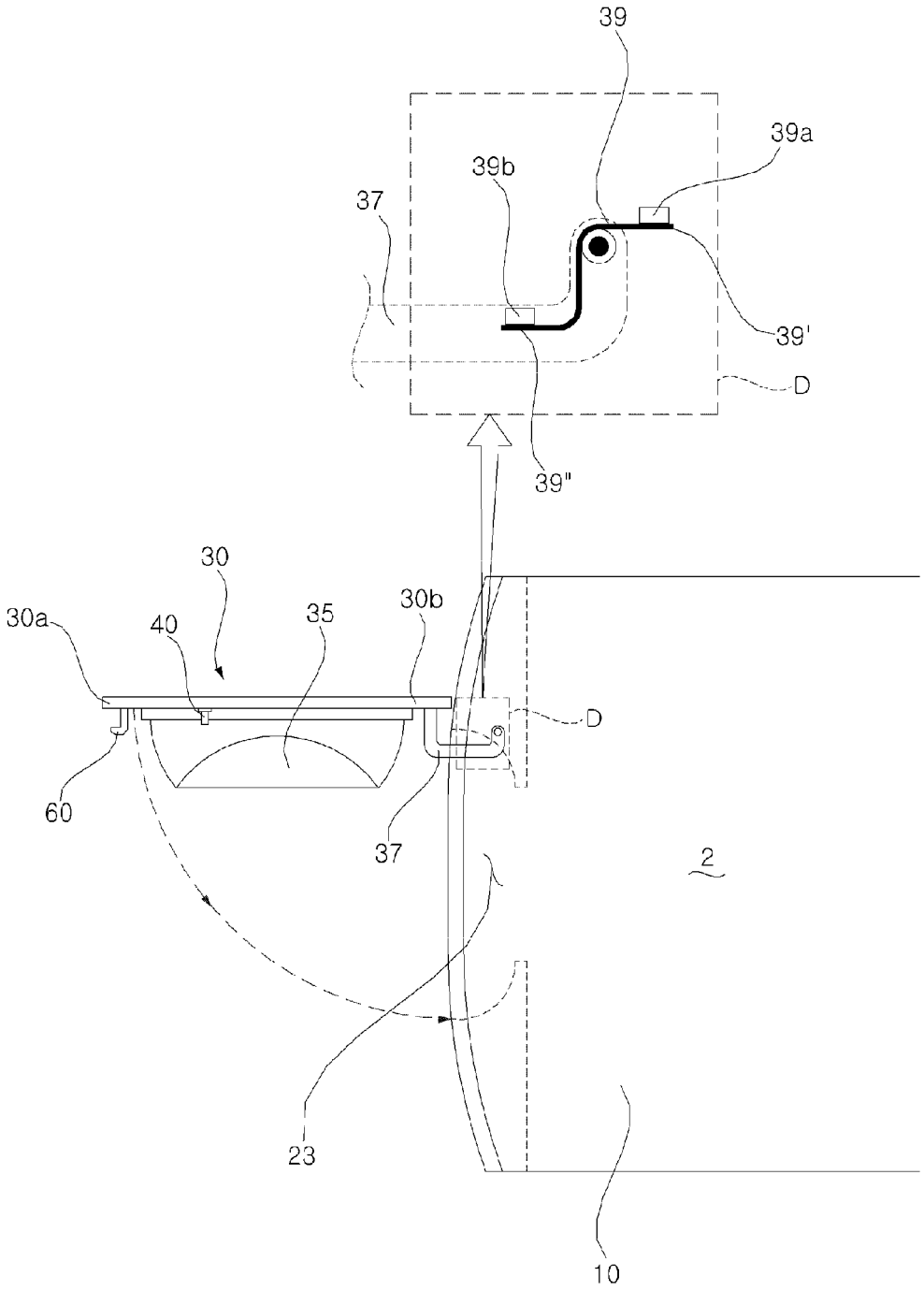
FIG. 3 is a plan view in a direction designated by the arrow A of FIG. 1.
Figure 4A:
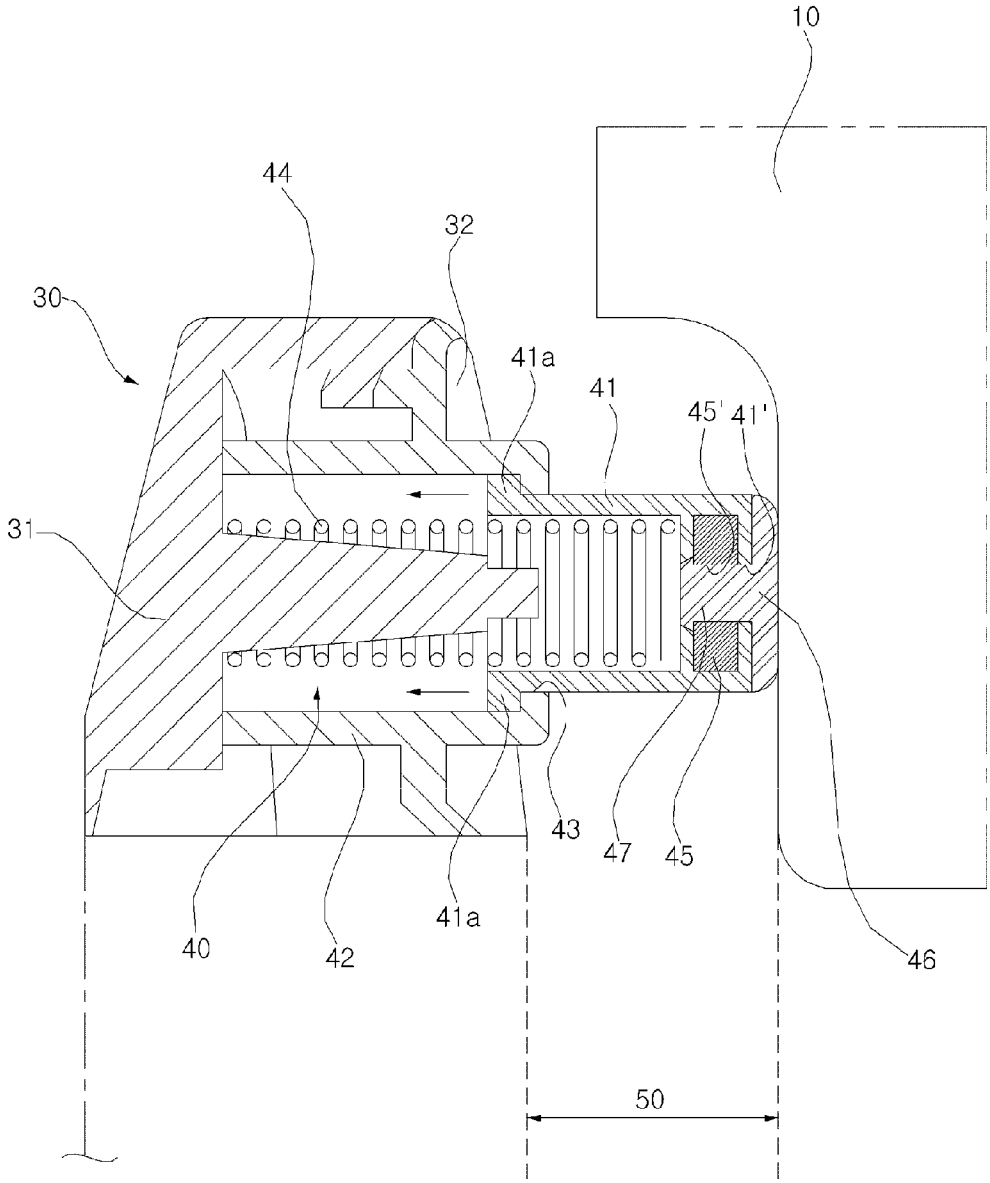
FIGS. 4A and 4B and FIG. 5 are partial sectional views taken along the line B-B of FIG. 1.
Figure 4B:
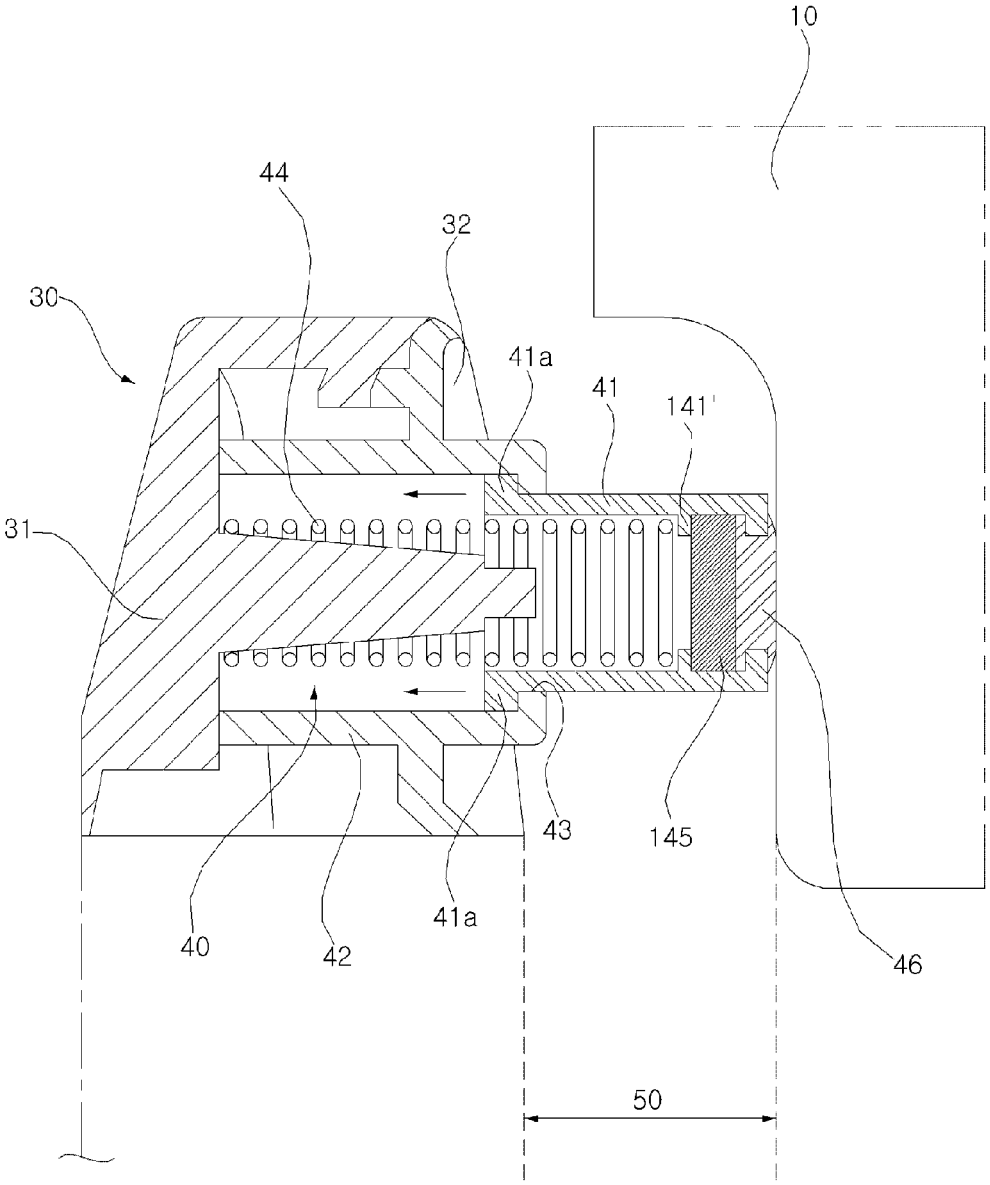
Figure 5:
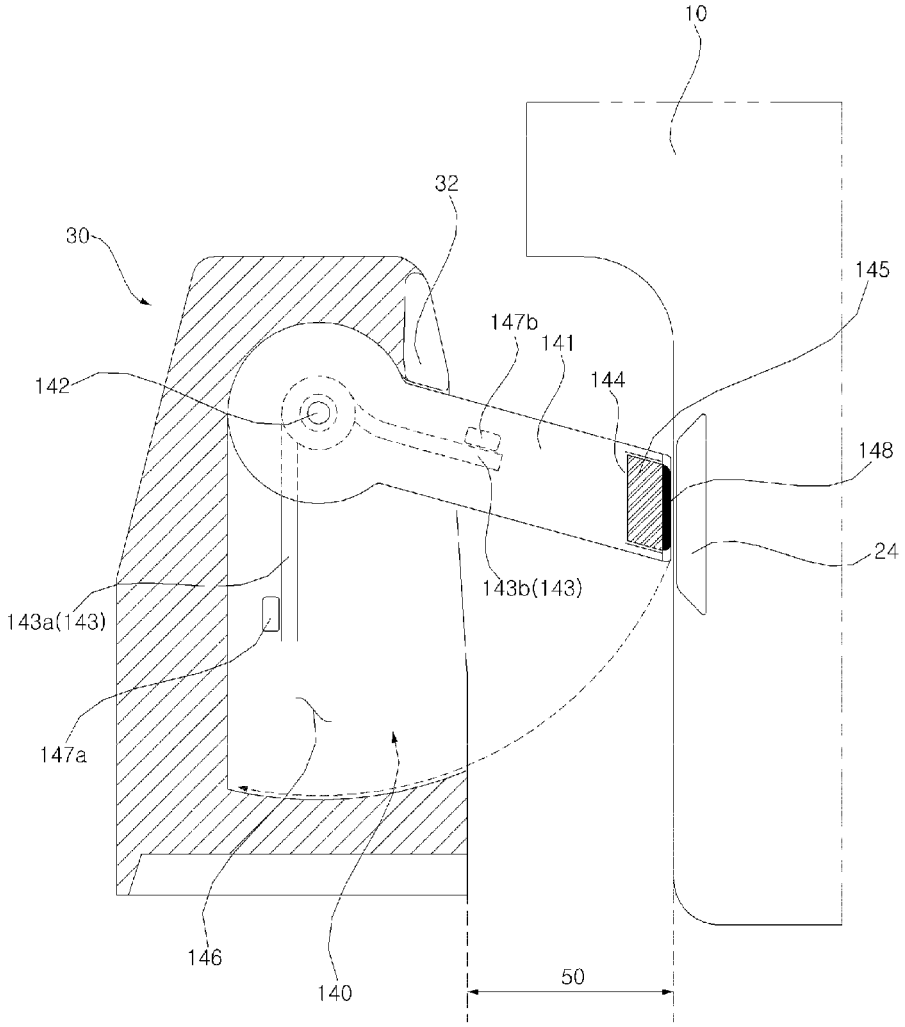
Figure 6A:
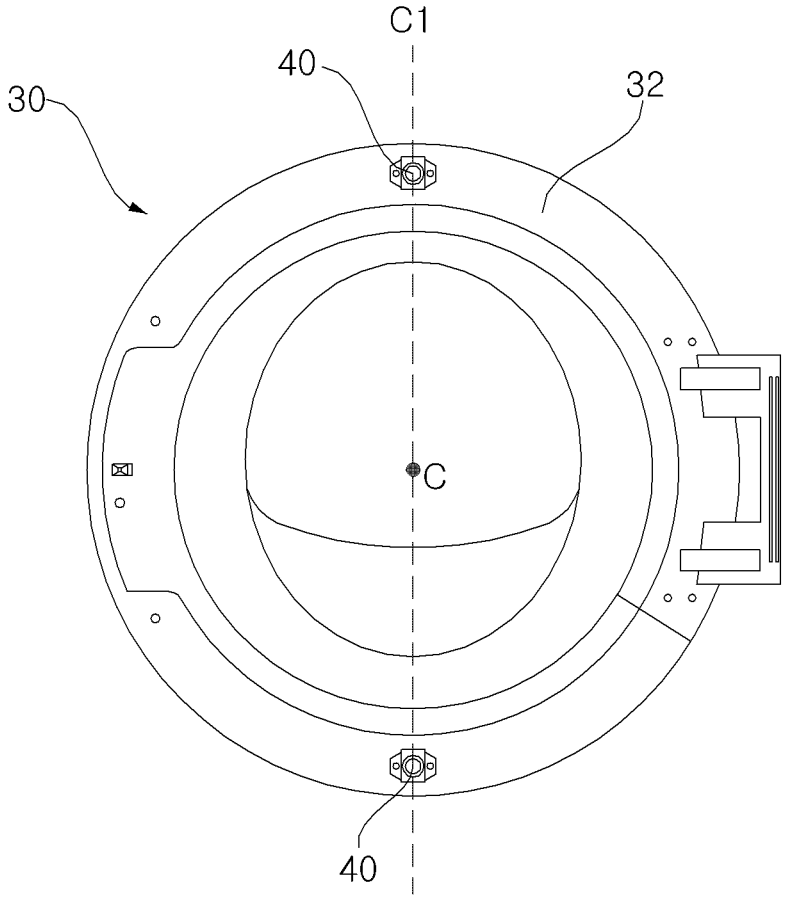
FIGS. 6A to 6C are rear views illustrating a rear surface of the front door of FIG. 1.
Figure 6B:
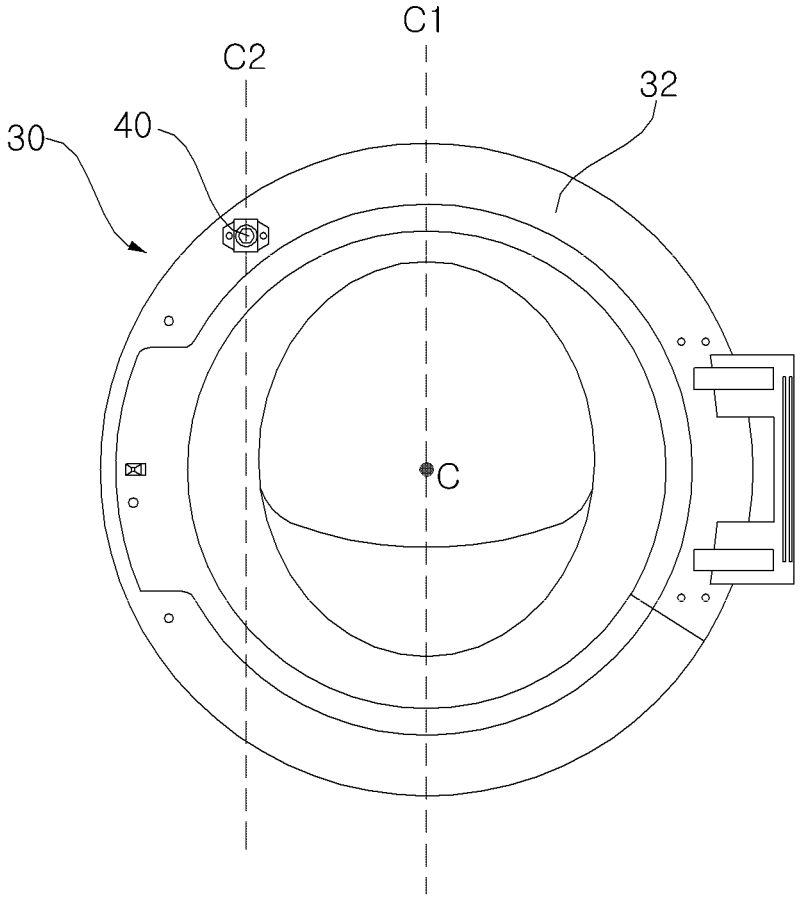
Figure 6C:
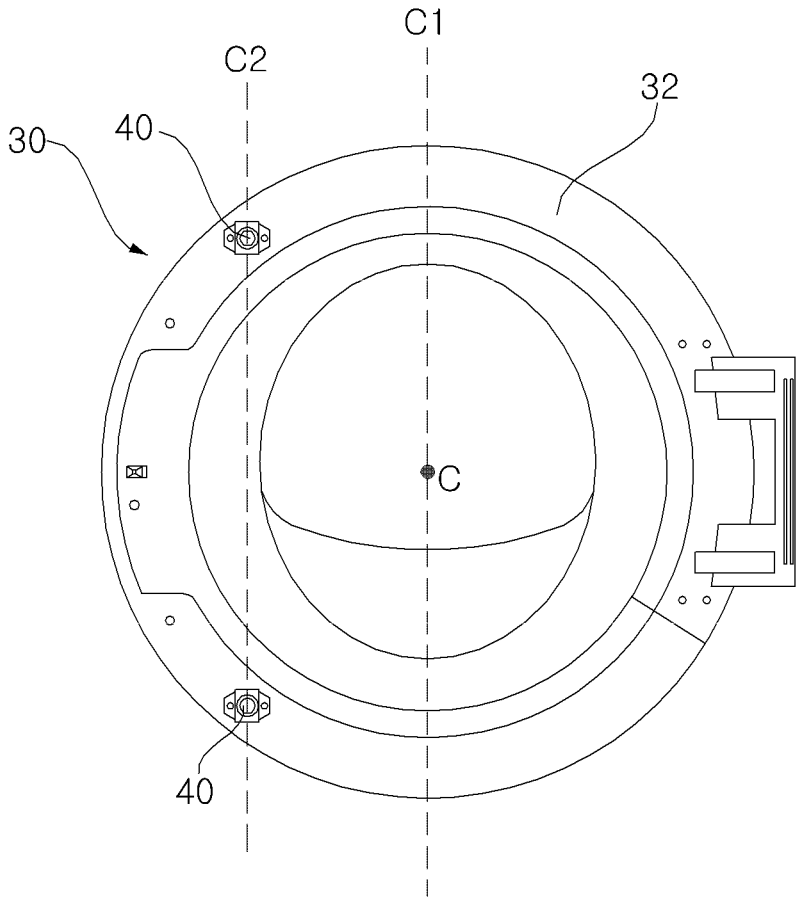

FIG. 1 is a perspective view illustrating a drum type washing machine according to an embodiment of the present invention. FIG. 2 is a schematic diagram illustrating a door latch assembly to lock or unlock a front door shown in FIG. 1. FIG. 3 is a plan view in a direction designated by the arrow A of FIG. 1. FIGS. 4A and 4B and FIG. 5 are partial sectional views taken along the line B-B of FIG. 1. Also, FIGS. 6A to 6C are rear views illustrating a rear surface of the front door of FIG. 1.

The drum type washing machine 1 according to the embodiment of the present invention, as shown in FIG. 1, includes a body 10 defining an interior space 2 to receive laundry therein for washing, the body 10 having an entrance opening 23 formed at a front surface 20 thereof to allow a user to put or take laundry into or out of the interior space 2 from the front side of the body 10, and a front door 30 rotatably installed at the front surface 20 of the body 10 so as to open or close the entrance opening 23 via pivotal rotation thereof.

The front door 30 comprises a hinge coupling part D provided between one end 30*b* of the front door 30 and the entrance opening 23. As the other end 30*a* of the front door 30 is rotated about the hinge coupling part D, the front door 30 moves toward the entrance opening 23, to close the entrance opening 23.

A hook is provided at a rear surface of the front door 30 in the vicinity of the other end 30*a* of the front door 30. Also, a door latch assembly 70 is provided at the corresponding side of the entrance opening 23. When the hook 60 latches to the door latch assembly 70 thereby locking the front door 30 during a wash cycle of the drum type washing machine 1, the hook 60 may serve not only to prevent unintentional opening of the front door 30 during washing, but also to prevent leakage of wash water from the interior space 2 of the body 10 to the outside.

The door latch assembly 70 serves to prevent the other end 30*a* of the front door 30 from being unintentionally pivotally rotated by locking a distal end of the hook 60 during the wash cycle. In addition, after completion of the wash cycle, the hook 60 is released from the door latch assembly 70 to allow the other end 30*a* of the front door 30 to be pivotally rotated.

More specifically, the door latch assembly 70, as shown in FIG. 2, includes a door latch body 71, a holder 72, a stopper 73, an operating rod 74, a moving rod 75, and an actuator 80. The door latch body 71 is positioned at the front surface 20 of the body 10 corresponding to the other end 30*a* of the front door 30. The holder 72 is rotatably arranged at the door latch body 71 to lock or release the hook 60 depending on whether the entrance opening 23 is closed or opened by the front door 30. The stopper 73 is vertically movably arranged at the door latch body 71 and is configured to come into contact with the holder 72. The stopper 73 serves to stop rotation of the holder 72 or to enable rotation of the holder 72 via vertical movement thereof. A distal end of the stopper 73 is connected to one end of the moving rod 75 and in turn, the other end of the moving rod 75 is connected to the operating rod 74. The operating rod 74 acts to vertically move the stopper 73 as well as the moving rod 75 linked to the operating rod 74. The actuator 80 is connected to the operating rod 74 by use of a wire 76 and serves to vertically move the operating rod 74.

Here, the actuator 80 is fully automatically operated in response to electric signals of a button operating unit 90. Preferably, the button operating unit 90 is located at an upper portion of the front surface 20 of the body 10 of the drum type washing machine 1, to allow the user to easily access the button operating unit 90.

Now, operation sequence of the door latch assembly 70 having the above described configuration will be described in brief. First, if the user manipulates the button operating unit 90 to unlock the front door 30, the wire 76 is pulled upward by the fully automatically operated actuator 80. In this case, the operating rod 74 connected to the wire 76 is moved upward within the door latch body 71, thereby acting to move the moving rod 75 upward and also, to move the stopper 73 connected to the moving rod 75 upward. As the moving rod 75 is moved upward, the holder 72 is rotated, thereby allowing the hook 60 to be released from the holder 72.

Meanwhile, the end 30*b* of the front door 30, as shown in FIG. 3, is rotatably coupled to the front surface 20 of the body 10 by the hinge coupling part D. Here, the hinge coupling part D includes an elastic member (hereinafter, referred to as a "door elastic member 39" to prevent confusion with another elastic member that actually differs from the door elastic member 39, but is denoted by the same term). One end 39' of the door elastic member 39 is supported by a first support 39*a* formed at one side of the entrance opening 23 and the other end 39" of the door elastic member 39 is supported by a second support 39*b* formed at a hinge rod 37 that is provided at the front door 30 to couple the front door 30 to the body 10.

The door elastic member 39 provides the front door 30 with an elastic force required to open the entrance opening 23 when the entrance opening 23 is closed by the front door 30. However, it is noted that the door elastic member 39 is not intended to exert an excessively strong elastic force. That is, the door elastic member 39 provides only a little elastic force sufficient to cause the front door 30 to be automatically spaced apart from the entrance opening 23 by a slight distance when the hook 60 is released from the door latch assembly 70 even if the user does not particularly apply an external force.

If the user pushes the button operating unit 90, for example, located at the upper portion of the front surface 20 of the body 10, the actuator 80 is operated to release the hook 60 from the holder 72. The door elastic member 39 applies the elastic force to the other end 30*a* of the front door 30 at the moment when the front door 30 is unlocked, thereby causing the front door 30 to be pivotally rotated by the hinge coupling part D. In this case, the user may advantageously feel sufficient operating sense because the front door 30 is moved forward by the elastic force of the door elastic member 39.

With the above described configuration in which the button operating unit 90 is located at the upper portion of the front surface 20 of the body 10 and the hook 60 is automatically latched by or released from the door latch assembly 70 by the fully automatically operated actuator 80, there is an advantage of increasing convenience in use.

Here, the door elastic member 39 may take the form of a torsion spring installed at the hinge coupling part D.

Now, considering a configuration of the front door 30 in more detail, the front door 30 includes a circular transmission portion 35 and a rim portion 33 around the transmission portion 35. The rim portion 33, as shown in FIGS. 4A and 4B, includes an outer frame 31 that defines a part of a front surface of the front door 30, and an inner frame 32 that is attached to a rear surface of the outer frame 31 and defines a part of a rear surface of the front door 30.

Here, the transmission portion 35 may be made of a transparent material to allow the user to observe the interior space 2 from the outside.

A rear surface of the transmission portion 35 may be raised inward of the interior space 2, to prevent laundry received in the interior space 2 from being jammed between the front door 30 and the entrance opening 23.

The resulting raised configuration is will be called an anti-jam protrusion. The anti-jam protrusion may be integrally formed at a rear surface of the transmission portion 35 as described above, or may be integrally formed at a part of the outer frame 31 of the rim portion 33 to protrude inward of the interior space 2, according to different embodiments of the present invention.

Hereinafter, the drum type washing machine 1 according to the embodiment of the present invention is described under the assumption that the anti-jam protrusion is obtained as the rear surface of the transmission portion 35 that is raised inward of the interior space 2.

Meanwhile, the drum type washing machine 1 according to the embodiment of the present invention, as shown in FIGS. 4A and 4B, further includes a supporting unit 40 provided at the front door 30. The supporting unit 40 is configured to come into contact with the body 10 when the entrance opening 23 is closed or opened by the front door 30, thereby serving to keep a predetermined distance between the front door 30 and the body 10.

Although the present embodiment exemplifies the supporting unit 40 provided at the front door 30, it will be appreciated that the supporting unit 40 may be provided at the body 10 to come into contact with the front door 30.

The supporting unit 40 serves to ventilate the interior space 2 of the body 10 through a predetermined distance between the front door 30 and the entrance opening 23 as described above, i.e. a ventilation gap 50.

When the supporting unit 40 defines the ventilation gap 50, it is noted that there is a need to prevent unintentional pivotal rotation of the front door 30. Specifically, the front door 30 must be spaced apart from the body 10 by the predetermined distance to define the ventilation gap 50 without a risk of interfering with surrounding objects or blocking the path of the user. In particular, since the laundry treating appliance, such as the drum type washing machine 1, may be usually directly installed at a kitchen where the user frequently passes, it is undesirable that the supporting unit additionally provided for the main purpose of ventilation becomes an obstacle to the path of the user.

To solve the above described problem, in the embodiment of the present invention, the supporting unit 40 includes a supporting body 41 movably placed between the front door 30 and the body 10 and a mount frame 42 formed at an inner end of the front door 30. The mount frame 42 has an insertion hole 43 so that the supporting body 41 is inserted into or protrudes out of the insertion hole 43.

When the hook 60 is released from the door latch assembly 70, the supporting body 41 continues to contact with the body 10 to connect the front door 30 to the body 10 until the other end 30*a* of the front door 30 is completely spaced apart from the body 10 via forward pivotal rotation thereof.

In this case, the ventilation gap 50 of the predetermined distance is defined between the body 10 and the other end 30*a* of the front door 30.

In addition, the supporting body 41 first comes into contact with the body 10 to connect the front door 30 to the body.

Even in this case, the ventilation gap 50 of the predetermined distance is defined between the body 10 and the other end 30*a* of the front door 30.

As described above, the supporting unit 40 defines the above described ventilation gap 50 when the front door 30 is opened away from or closed to the entrance opening 23, thereby serving to ventilate the interior space 2 of the body 10.

The mount frame 42 may be integrally formed at the inner frame 32 of the rim portion 33 that defines a part of the rear surface of the front door 30.

The mount frame 42 is formed with the insertion hole 43 so that the supporting body 41 is movable toward the body 10 while being inserted in the insertion hole 43. The supporting body 41 may be integrally formed with an anti-separation protrusion 41*a* to prevent the supporting body 41 from being separated from the insertion hole 43.

The insertion hole 43 may have a depth of at least greater than a length of the supporting body 41.

The supporting body 41 is elastically supported by an elastic member fitted in the insertion hole 43 (hereinafter, referred to as a "first supporting elastic member 44" in correspondence to the door elastic member 39) so as to be movable toward the body 10. The first supporting elastic member 44 elastically supports the supporting body 41 toward the body 10 when the hook 60 is released from the door latch assembly 70, thereby acting to push the other end 30*a* of the front door 30 forward in cooperation with the door elastic member 39 provided at the hinge coupling part D and enabling creation of the ventilation gap 50.

The supporting unit 40 may further include a magnet 45 formed at a tip end of the supporting body 41 opposite to the anti-separation protrusion 41*a* of the supporting body 41. The magnet 45 serves to achieve magnetic coupling between the supporting body 41 and the body 10.

The magnet 45 is a kind of a magnetic substance creating a magnetic field, and is coupled to the tip end of the supporting body 41 so as to magnetically couple the supporting body 41 to the body 10.

The supporting body 41 provided with the magnet 45 may be formed by injection molding such that the magnet 45 has been inserted in the supporting body 41. Injection molding the supporting body 41 in which the magnet 45 has been inserted eliminates a need for a process of inserting the magnet 45 into the completely formed supporting body 41, resulting in simplified manufacture of the supporting unit 40.

Here, a partial region of the body 10 which comes into contact with the supporting body 41 under the influence of the magnet 45 is preferably made of a metallic material easy to be magnetically attracted by the magnet 45.

The supporting unit 40 further includes a noise-proof bump 46 coupled to the tip end of the supporting body 41 and serves to prevent generation of noise when the supporting body 41 comes into contact with the body 10.

The noise-proof bump 46 is coupled to the tip end of the supporting body 41 so as to be interposed between the supporting body 41 and the body 10, thereby serving to prevent generation of noise when the magnet 45 or the tip end of the supporting body 41 comes into direct contact with the metallic contact region of the body 10.

Here, the noise-proof bump 46 may be made of silicone or rubber, in order to minimize generation of contact noise.

To couple the above described noise-proof bump 46 to the tip end of the supporting body 41, coupling holes 41' and 45' are perforated through the tip end of the supporting body 41 and the center of the magnet 45 such that the noise-proof bump 46 penetrates through the coupling holes 41' and 45' and is caught by the magnet 45.

Here, a distal portion of the noise-proof bump 46 penetrating through the coupling holes 41' and 45' is formed with a fastening end 47 such that the fastening end 47 is caught by the magnet 45 to achieve the fastening of the noise-proof bump 46.

However, it is not essential that the supporting body 41 must always be formed by injection molding such that the magnet 45 has been inserted as described above. In another embodiment of the present invention, as shown in FIG. 4B, the supporting body 41 of the supporting unit 40 may be formed by double injection molding that is suitable for a heterogeneous molded article.

Here, due to the fact that the magnet 45 is unsuitable as an injection molding material, objects to be formed by double injection molding may include the supporting body 41 and the noise-proof bump 46 coupled to the tip end of the supporting body 41.

That is, the supporting body 41 and the noise-proof bump 41 may be advantageously formed simultaneously by double injection molding.

Specifically, as shown in FIG. 4B, the tip end of the supporting body 41 formed by double injection molding as described above is provided with a seating recess 141' such that a magnet 145 is inserted and seated in the seating recess 141'. The coupling of the supporting unit 40 according to the present embodiment is completed by fitting the noise-proof bump 46, formed by double injection molding, to the tip end of the supporting body 41 in a state wherein the magnet 145 has been seated in the seating recess 141'.

The supporting unit 40 according to the above described different embodiments of the present invention is characterized by protruding straightly rearward from the front door 30 toward the body 10 by a predetermined distance when no external force is applied, e.g., to cause the supporting body 41 to come into contact with the body 10.

However, in the drum type washing machine 1, it is not always necessary for the supporting unit 40 to protrude straightly rearward from the body 30 toward the body 10 when no external force is applied as described above. More specifically, in another embodiment, as will be described hereinafter, one end of a supporting body 141 of a supporting unit 140 may be coupled to the front door 30 by a supporting hinge coupling member 142 provided in an insertion hole 146. Accordingly, the other end of the supporting body 141 is rotatable about the supporting hinge coupling member 142, allowing the supporting unit 140 to be movable to or away from the front door 30.

FIG. 5 illustrates the another embodiment of the present invention. As shown in FIG. 5, the other end of the supporting body 141 may obliquely protrude toward the body 10 when no external force is applied.

The reason why the other end of the supporting body 141 obliquely protrudes toward the body 10 is to prevent the front door 30 from coming into contact with the body 10 thus defining the ventilation gap 50 between the front door 30 and the body 10.

Although the other end 30*a* of the front door 30 is prevented to come into close contact with the body 10 when the other end of the supporting body 141 comes into contact with the body 10, with the above described configuration, the supporting body 141 may be rotated and inserted into the insertion hole 146 upon receiving an external force applied to the front door 30, thereby allowing the other end 30*a* of the front door to come into close contact with the body 10.

The above described supporting body 141 is elastically supported by a second supporting elastic member 143 coupled to a supporting hinge coupling member 142. One end 143*a* of the second supporting elastic member 143 is supported by the front door 30 and the other end 143*b* supports the other end of the supporting body 141 to allow the other end of the supporting body 141 to be rotated about the supporting hinge coupling member 142.

Here, the second supporting elastic member 143 may take the form of a torsion spring coupled to the supporting hinge coupling member 142.

The second supporting elastic member 143 in the form of a torsion spring has the end 143*a* supported by a first support 147*a* placed in the insertion hole 146 and the other end 143*b* supported by a second support 147*b* provided at the supporting body 141.

In the above described configuration of the drum type washing machine 1 according the another embodiment of the present invention, similar to the supporting unit 40 of the previously described embodiments, a partial region of the supporting unit 140 which comes into contact with the body 10 is preferably made of a metallic material, and the supporting body 141 further includes the magnet 145 to achieve magnetic coupling between the supporting body 141 and the body 10.

In addition, a noise-proof bump 148 may be provided at a tip end of the supporting body 141, to prevent generation of noise when the supporting body 141 comes into contact with the body 10. Accordingly, the nose-proof bump 148 may be coupled to the tip end of the supporting body 141 at a position between the supporting body 141 and the body 10.

In the above described various embodiments of the present invention, there may be provided a plurality of supporting units 40 or 140, including the supporting bodies 41 or 141, at the inner end of the front door 30.

Specifically, in the drum type washing machine according to the embodiment of the present invention, as shown in FIGS. 6A to 6C, a single supporting unit 40 or a plurality of supporting units 40 may be arranged at the inner frame 32 constituting the rim portion 33 of the front door 30.

More specifically, referring to FIG. 6A illustrating a first embodiment with respect to installation of the supporting unit, two supporting units 40 may be installed to the inner frame 32 of the rim portion 33 at upper and lower positions spaced apart from each other of an imaginary vertical axis C1 that passes through the center C of the transmission portion 35.

Alternatively, referring to FIG. 6B illustrating a second embodiment with respect to installation of the supporting unit, a single supporting unit 40 may be installed to the inner frame 32 of the rim portion 33 at either upper or lower position of an imaginary vertical axis C2 that is positioned between the imaginary vertical axis C1 passing through the center C of the transmission portion 35 and the other end 30*a* of the front door 30.

Alternatively, referring to FIG. 6C illustrating a third embodiment with respect to installation of the supporting unit, two supporting units 40 may be installed to the inner frame 32 of the rim portion 33 at upper and lower positions spaced apart from each other of the imaginary vertical axis C2.

Here, the imaginary vertical axis C2 is preferably positioned close to the other end 30*a* of the front door 30.

In the above described first to third embodiments, a factor to determine the installation position and the installation number of the supporting unit 40 is an elastic force of the first supporting elastic member 44 (or of the second supporting elastic member 143) and a magnetic force of the magnet 45 (or of the magnet 145).

Considering an opening force of the front door 30 under the influence of the elastic force of the first supporting elastic member 44 (or of the second supporting elastic member 143) on the basis of the imaginary vertical axis C1 that passes through the center C of the transmission portion 35, an opening force accomplished when the supporting unit 40 is installed on the rear surface of the front door 30 at the upper position of the imaginary vertical axis C1 is higher than an opening force accomplished when the supporting unit 40 is installed at the lower position of the imaginary vertical axis C1. Of course, when the two supporting units 40 are installed at both the upper and lower positions of the imaginary vertical axis C1, the greatest opening force of the front door 30 may be accomplished.

Also, considering the opening force of the front door 30 under the influence of the elastic force of the first supporting elastic member 44 (or of the second supporting elastic member 143) on the basis of the imaginary vertical axis C2 that is positioned between the center C of the transmission portion 35 and the other end 30*a* of the front door 30, an opening force accomplished when the supporting unit 40 is installed on the rear surface of the front door 30 at the lower position of the imaginary vertical axis C2 is higher than an opening force accomplished when the supporting unit 40 is installed at the upper position of the imaginary vertical axis C2. Of course, when the two supporting units 40 are installed at both the upper and lower positions of the imaginary vertical axis C2, the greatest opening force of the front door 30 may be accomplished.

In addition, comparing the opening force of the front door 30 under the influence of the elastic force of the first supporting elastic member 44 (or of the second supporting elastic member 143) on the basis of the imaginary vertical axis C1 with that on the basis of the imaginary vertical axis C2, the opening force obtained when the two supporting units 40 are installed at the upper and lower positions of the imaginary vertical axis C1 is lower than the opening force obtained when the single supporting unit 40 is installed at the lower position of the imaginary vertical axis C2.

In conclusion, the opening force of the front door 30 becomes the greatest when the supporting units 40 are installed at the upper and lower positions of the imaginary vertical axis C2 and also, becomes the smallest when the supporting unit 40 is installed at the lower position of the imaginary vertical axis C1.

As will be appreciated from the above description, the opening force of the front door 30 may be changed according to the installation position of the supporting unit and therefore, the magnetic force of the magnet 45 may be changed. As compared to the elastic force of the first supporting elastic member 44 (or of the second supporting elastic member 143) that acts to increase the opening force of the front door 30, the magnetic force of the magnet 45 may act to assure the reliable magnetic coupling of the supporting body 41 and the body 10. If the magnetic force of the magnet 45 is very low, the supporting body 41 may have difficulty magnetically coupling to the body 10. Therefore, when the supporting units 40 are installed at both the upper and lower positions of the imaginary vertical axis C2, the magnetic force of the magnet 45 should be increased.

Assuming that the front door 30 is designed to be automatically opened as shown in FIG. 2, the front door 30 should exhibit a great opening force and therefore, it is preferable that the supporting units 40 be installed at both the upper and lower positions of the imaginary vertical axis C2. On the contrary, when the front door 30 is designed to be manually opened by the user, it may be that the supporting unit 40 is installed only at the lower position of the imaginary vertical axis C1.

Hereinafter, operation sequence of the drum type washing machine 1 according to an embodiment of the present invention will be described in detail with reference to the accompanying drawings on the basis of the case where the entrance opening 23 is closed by the front door 30 and also, on the basis of the case where the entrance opening 23 is opened by the front door 30.

Considering the case where the entrance opening 23 is closed by the front door 30 with reference to FIG. 4A, if the user pushes the front door 30 to close the entrance opening 23, the other end 30*a* of the front door 30 is rotated about the end 30*b* of the front door 30, thereby being moved toward the entrance opening 23. In this case, the supporting body 41 is kept protruded toward the entrance opening 23 by the first supporting elastic member 44. With a further continuous movement of the front door 30, the tip end of the supporting body 41 is brought into contact with one side of the entrance opening 23.

Here, if the user does not apply a further external force, the magnet 45 arranged at the tip end of the supporting body 41 comes into contact with the body 10, thereby allowing the front door 30 to be magnetically coupled to the body 10 while forming/maintaining the ventilation gap 50 of the predetermined distance between the front door 30 and the body 10. In this case, although the door elastic member 39 provided in the hinge coupling part D corresponding to the end 30*b* of the front door 30 exhibits an elastic force to push the front door 30 forward, the elastic force to push the front door 30 forward is smaller than the magnetic attraction of the magnet 45. Accordingly, the front door 30 may continuously maintain the ventilation gap 50 at normal times when the drum type washing machine 1 is not in use.

On the other hand, the case where the entrance opening 23 is opened by the front door 30 with reference to FIG. 4A, if the user manipulates the button operating unit 90 provided at the upper portion of the front surface 20 of the body 10 when it is desired to put laundry into the interior space 2 through the entrance opening 23, the actuator 80 is operated to pull the wire 76 upward, causing the holder 72 to be rotated via cooperation of the operating rod 74, the moving rod 75, and the stopper 73. In this case, the hook 60 is released from the holder 72 and the other end 30*a* of the front door 30 is slightly moved forward about the hinge coupling part D by the elastic force of the door elastic member 39. Here, since the magnetic attraction between the magnet 45 and the body 10 is greater than the elastic force to push the other end 30*a* of the front door 30 forward caused by the door elastic member 39, the front door 30 continuously maintains the ventilation gap 50 at normal times when the drum type washing machine 1 is not in use.

Then, when the user attempts to put laundry into the interior space 2 through the entrance opening 23, the user may easily open the front door 30 by grasping portion of the front door 30, and pulling the front door 30 open.

Meanwhile, the supporting unit 40 may be utilized as described hereinafter. Specifically, even if the user does not take the laundry out of the interior space 2 after completion of a wash cycle, the supporting unit 40 may automatically define the ventilation gap 50, thereby serving to ventilate the interior space 2 that has relatively high humidity due to the wet laundry.

To utilize the supporting unit 40 as described above, in the drum type washing machine 1, a control unit (not shown) is provided to operate the actuator 80 after completion of the wash cycle (here, the wash cycle is a concept including a rinse cycle and a spin cycle) even if the user does not manipulate the button operating unit 90, thereby allowing the hook 60 to be released from the door latch assembly 70 and consequently, causing the front door 30 to be unlocked.

As a result, the ventilation gap 50 may be formed/maintained between the front door 30 and the body 10 via sequential implementation of the following operations as described above, and this may advantageously prevent propagation of bacteria in the interior space 2 in summer, for example.

Although the configurations, operation sequences and effects of the drum type washing machine according to the embodiments of the present invention have been described in detail with reference to the accompanying drawings, it will be understood by those skilled in the art that example embodiments can be implemented in other specific forms without changing the technical spirit or essential features of the present invention. Therefore, it should be noted that the forgoing embodiments are merely illustrative in all aspects and are not to be construed as limiting the invention. The scope of the invention is defined by the appended claims rather than the detailed description of the invention. All changes or modifications or their equivalents made within the meanings and scope of the claims should be construed as falling within the scope of the invention.

Accordingly, the drum type washing machine described above may achieve one or more effects as follows:

Firstly, ventilation of the interior space of the body by use of the supporting unit when the drum type washing machine is not in use may be achieved. This has the effects of preventing propagation of bacteria and consequently, assuring cleanliness and sanitation of clothes.

Secondly, it is unnecessary for the user to manually open the front door in order to ventilate the interior space of the body. This may result in increased convenience of use.

Thirdly, since the supporting unit is designed so as not to excessively open the front door, the front door may have no risk of interfering with surrounding objects and also, superior exterior aesthetics of the surrounding may be accomplished.

The effects are not limited to the above, and other effects not mentioned above can be clearly understood from the definitions in the claims by one skilled in the art.

What is claimed is:

1. A drum type washing machine comprising:

a body having a front surface thereof with an entrance opening for entrance/exit of laundry;

a front door rotatably coupled at one end thereof to the front surface of the body and serving to open or close the entrance opening;

a door elastic member providing the front door with an elastic force required to open the entrance opening when the entrance opening is closed by the front door;

a hook provided at the front door;

a door latch assembly provided at the body to latch the hook for locking the front door; and a supporting unit installed to the front door to contact with the body when the hook is latched to the door latch assembly, wherein the supporting unit includes:

a mount frame formed at an inner end of the front door and having an insertion hole;

a supporting body inserted in the insertion hole, the supporting body being movable toward the body, the supporting body has an anti-separation protrusion to prevent the supporting body from being separated from the insertion hole;

a spring installed in the mount frame and serving to support the supporting body so as to allow the supporting body to protrude out of the insertion hole when no external force is applied to the supporting body;

a magnet disposed at an end of the supporting body to magnetically couple the supporting unit to the body; and a noise-proof bump disposed at a tip end of the supporting body to prevent generation of noise when the supporting body comes into contact with the body, wherein the magnet has a coupling hole at a center thereof, and the noise-proof bump has a fastening end penetrating through the coupling hole, thereby the magnet fastens the noise-proof bump, wherein a magnetic attraction between the magnet and the body is greater than the elastic force of the door elastic member, and wherein the supporting unit continues to contact with the body by the magnetic attraction of the magnet when the hook is released from the door latch assembly, thereby serving to keep the front door at a predetermined distance from the body.

2. The drum type washing machine of claim 1, wherein:

the front door includes:

an outer frame defining an external appearance of a front surface of the front door; and an inner frame attached to a rear surface of the outer frame and defining an external appearance of a rear surface of the front door, wherein the mount frame is integrally formed with the inner frame.

3. The drum type washing machine of claim 1, wherein the supporting unit is located at an upper or lower circumferential position of the front door between a center vertical axis passing through the center of the front door and the other end of the front door.

4. The drum type washing machine of claim 1, further comprising at least two supporting units spaced apart from each other at upper and lower positions on an arbitrary vertical axis between a center vertical axis passing through the center of the front door and the other end of the front door.

5. The drum type washing machine of claim 1, wherein the supporting unit is located at an upper or lower circumferential position of the front door on a center vertical axis passing through the center of the front door.

6. The drum type washing machine of claim 1, further comprising at least two supporting units spaced apart from each other at upper and lower positions on a center vertical axis passing through the center of the front door.

* * * * *